United States Patent [19]

Stoppazzini

[11] Patent Number: 4,766,742

[45] Date of Patent: Aug. 30, 1988

[54] PERFECTED AUTOMATIC FLAT KNITTING MACHINE

[75] Inventor: Benito Stoppazzini, Sala Bolognese, Italy

[73] Assignee: E.M.M. S.R.L., Italy

[21] Appl. No.: 119,199

[22] Filed: Nov. 10, 1987

[30] Foreign Application Priority Data

Nov. 11, 1986 [IT] Italy ..... 3571 A/86

[51] Int. Cl.[4] ..... D04B 7/00

[52] U.S. Cl. ..... 66/75.1; 66/78

[58] Field of Search ..... 66/75.1, 75.2, 78, 64

[56] References Cited

U.S. PATENT DOCUMENTS 4,294,085 10/1981 Trautner ..... 66/75.1

4,481,793 11/1984 Cuche et al. ..... 66/75.2

4,490,994 1/1985 Essig ..... 66/75.1

4,571,955 2/1986 Stoppazzini ..... 66/75.1

4,667,488 5/1987 Stoppazzini ..... 66/75.1

*Primary Examiner*—Ronald Feldbaum

*Attorney, Agent, or Firm*—Darby & Darby

[57] ABSTRACT

An automatic flat knitting machine needle beds feature equidistantly spaced slots, perpendicular to the direction of travel of a carriage, inside each of which is inserted a needle and a sinker for selecting the latter, the needle featuring a butt that is mounted on it by means of a spring extension bent towards the inside of its related slot, so that the butt of the non-selected needle is not struck by the operational cams of the carriage, whereas the butt of the selected needle is struck by the operational cams of the carriage, due to the fact that the extension is bent towards the outside of the slot as a result of its having been struck by the upper head of the selection sinker.

8 Claims, 6 Drawing Sheets

G1
G2
G3
T1
T2
T
H2
L1
L2
L3
B1
B2
B3
R
R1
R2
R3'
R3''
R4
R5
R6
R7
R8
R9
R10
1
2
3
4
5
6
7
8
15
16
17a
17b
17c
17d
17e
17f
17m
17n
18a
18b
18c
18d
19
20
21
28
50
Z

PERFECTED AUTOMATIC FLAT KNITTING MACHINE

BACKGROUND OF THE INVENTION

The invention relates to a perfected automatic flat knitting machine.

DESCRIPTION OF THE PRIOR ART

It is known that the needle beds of automatic flat knitting machines feature equidistant slots that are perpendicular to the direction of travel of the carriage. In each slot, proceeding from top to bottom, in order, there are a needle, the butt of which projects from the plane of the needle bed, and a sinker.

The said sinker (see EPC No. 85830068.4 filed in the name of the same applicant) has four butts, first, second, third and fourth butt, respectively, all protruding from the needle bed and the fourth of which is joined to the body of the sinker by a spring extension.

The carriage has a number of cam assemblies for the selection of the sinkers, the said cam assemblies being movable from an idle to a work position, at which work position the movable cam strikes against the second butt of the corresponding sinker.

The striking of the cam causes the sinker to rise from the idle position to and intermediate position; in this position the operational cams in a first cam assembly strike against the fourth butt first, and the first butt afterwards, in order to raise the sinker further and then lower it again into the idle position.

Raising the sinker beyond a predetermined position causes the sinker itself to strike against the needle above it, thus lifting it upwards. This enables the operational cams in a second cam assembly to strike against the butt of the needle; the latter is thus sent into operation (outward stroke) in order to either form a stitch, transfer one to or from another needle bed, or form what is known as a carry-over stitch.

It is known that the length of the return stroke of the needle, before the latter is returned to its initial idle position, determines the density (or "fineness") of the knit; the density of the knit, to be precise, decreasing with an increase in the value of the said length of stroke.

The return stroke of the needle is determined by operational cams in the second cam assembly, including a knitting density adjustment cam, which is mounted inclined upon a slide which forms an integral part of the carriage, this latter cam being located downstream of those mentioned above, in relation to the direction of travel of the carriage.

Since the carriage operates in both directions, there are two symetrical control cams located in a plane perpendicular to the direction of the carriage's movement.

The adjustment cam, located downstream, moves the butt of the needle downwards, beyond the butt's idle position; suitable fixed cams (or a third operational cam assembly), an integral part of the carriage, strike against the aforementioned butt, returning it to its related idle position once again.

The butt of the needle which has not been sent into operation, (which means its corresponding sinker has not been selected), is also struck by the adjustment cam (located downstream); this causes the butt to move down further than its idle position, and to be subsequently lifted up again (due to its having been struck by the said fixed cams) into its idle position.

As a result of this, those needles which are not sent into operation oscillate in relation to their idle position, such that the knitting yarn, hooked to the latch of the needle, is first put under tension and then released, with all the disadvantages this involves.

Each time the adjustment cam comes into contact with the butt of the needle, it is subjected to both the elastic reaction of the taut knitting yarn, hooked by the latch of the needle, and by a "hammering" action caused by the impact of the cam against the butt, as well as by the separation of this latter from the cam itself; the butt also being subject to impacts which have the negative effect of its reducing its service life.

The forces to which the butt of the needle and adjustment cam are subjected, and the situation in which the yarn is first placed under tension and then released, are not only inevitable when the needle is sent into operation, but also take place with the same disadvantages when the needle is not selected, that is to say not sent into operation: this severely limits the productivity of flat automatic knitting machines having the same number of sinker selection cam assemblies.

DE No. 2002991 discloses a flat knitting machine that features at least one intermediate sinker between the selection sinker and needle; the needle features no butts, and the intermediate sinker is hinged to the needle at one end, the remaining end being held into the bottom of the related slot under the action of elastic means.

The intermediate sinker is lifted up by the selection sinker, whilst the needle is sent into operation when a butt forming part of the intermediate sinker is struck by cams mounted on the carriage.

The carriage features pressure cams that strike against the above-mentioned butt when the selection cam has not been activated, (this equating with not sending the coprresponding needle into operation); as a result of this, the butt is pressed into the slot, due to the elastic action of the intermediate sinker, so that it is not struck by the cams situated downstream in relation to the direction of travel of the carriage (e.g. the aforementioned adjustment cam).

Such a technical solution is obviously of complex construction, and, furthermore, involves the butts being struck by the pressure cams.

SUMMARY OF THE INVENTION

The object of the invention is to propose improvements to an automatic knitting machine able to prevent the operational cams of the carriage of such a machine from striking against those needles which have not been selected, without this in any way compromising the efficient operation of those needles selected.

A further object of the invention is to propose improvements making it possible, when necessary, to send non-selected needles into operation aswell.

The said objects are achieved in the present invention by means of a perfected automatic knitting machine including two flat needle beds inclined away from each other in a downwards direction, and located so that they are symmetrical to one another in a longitudinal vertical plane, each of these needle beds having equidistantly spaced slots in each of which a needle featuring a butt is located from the top proceeding downwards, and a sinker featuring at least four butts, first, second, third and fourth butt, respectively, all protruding from the related needle bed; the said machine also being fitted with a carriage that runs above the needle beds, including, amongst its other parts: movable selection cams, each of which, when in its operational position, strikes against the second butt of the corresponding sinker selected, consequently raising the latter from its idle position to a first intermediate position; a first assembly of movable and/or fixed operational cams designed to strike against the above-mentioned first and fourth butts of the selected sinker, lifting the latter from its said first intermediate position to a fully raised position and subsequently lowering it to the idle position, the lifting of the sinker beyond a predetermined second intermediate position, higher than the first intermediate position, causing the sinker to strike against the needle, as a result raising the needle from its idle position to a first level; a second assembly of operational fixed and/or movable cams which operate in a first longitudinal band extending above and below the longitudinal line formed by the butts of the needles in their idle position, the said cams being equidistant from the face of the needle bed below them, located at a predetermined first distance away from it; a third operational fixed cam assembly, located downstream of the aforementioned second assembly in relation to the direction of travel of the carriage, operating in a second longitudinal band extending below the said longitudinal line, the cams in which are equidistant from the needle bed below them, located at a second predetermined distance away from it, the length of which is lower than the first distance; the said machine being characterised by the fact that the butt of the needle is mounted on the needle body by means of a spring extension which, in the idle position, keeps the butt partially within its related slot, from which it protrudes into the above-mentioned second band alone; by the fact that the upper head of the sinker strikes against the said spring extension, as a result of the sinker itself being beyond the aforesaid second intermediate position, this causing the spring extension to bend towards the outside of the related slot, thus allowing the butt of the needle to enter the above-mentioned first band; by the fact that the aforesaid sinker and needle feature a ledge and stop respectively, that are brought into contact with one another, causing both the sinker and needle to be driven in the same direction, when the butt of the latter has been positioned in the aforementioned first band; by the fact that the carriage features means for striking the butt of the needle, designed to guide the lifting of the latter as a result of the head of the sinker striking against the above-mentioned extension.

The butt of a non-selected needle is only ever located in the second band, and is thus not struck by the operational cams in the second cam assembly; as a result of this the butt itself remains in its idle position. The butt of a selected needle operates in the first band, and is thus struck by the operational cams in the second cam assembly; as a result of this the butt itself is first lifted and then lowered below its idle position; in this position, the selection sinker and needle extension are disengaged, which brings the butt of the latter into the second band: the operational cams in the third cam assembly consequently strike the butt of the needle, which is returned to the idle position again.

BRIEF DESCRIPTION OF THE DRAWINGS

The characteristics of the invention are emphasised hereinafter with specific reference to the enclosed drawings, in which.

DESCRIPTION OF THE PREFERRED EMBODIMENT

Figure 1:
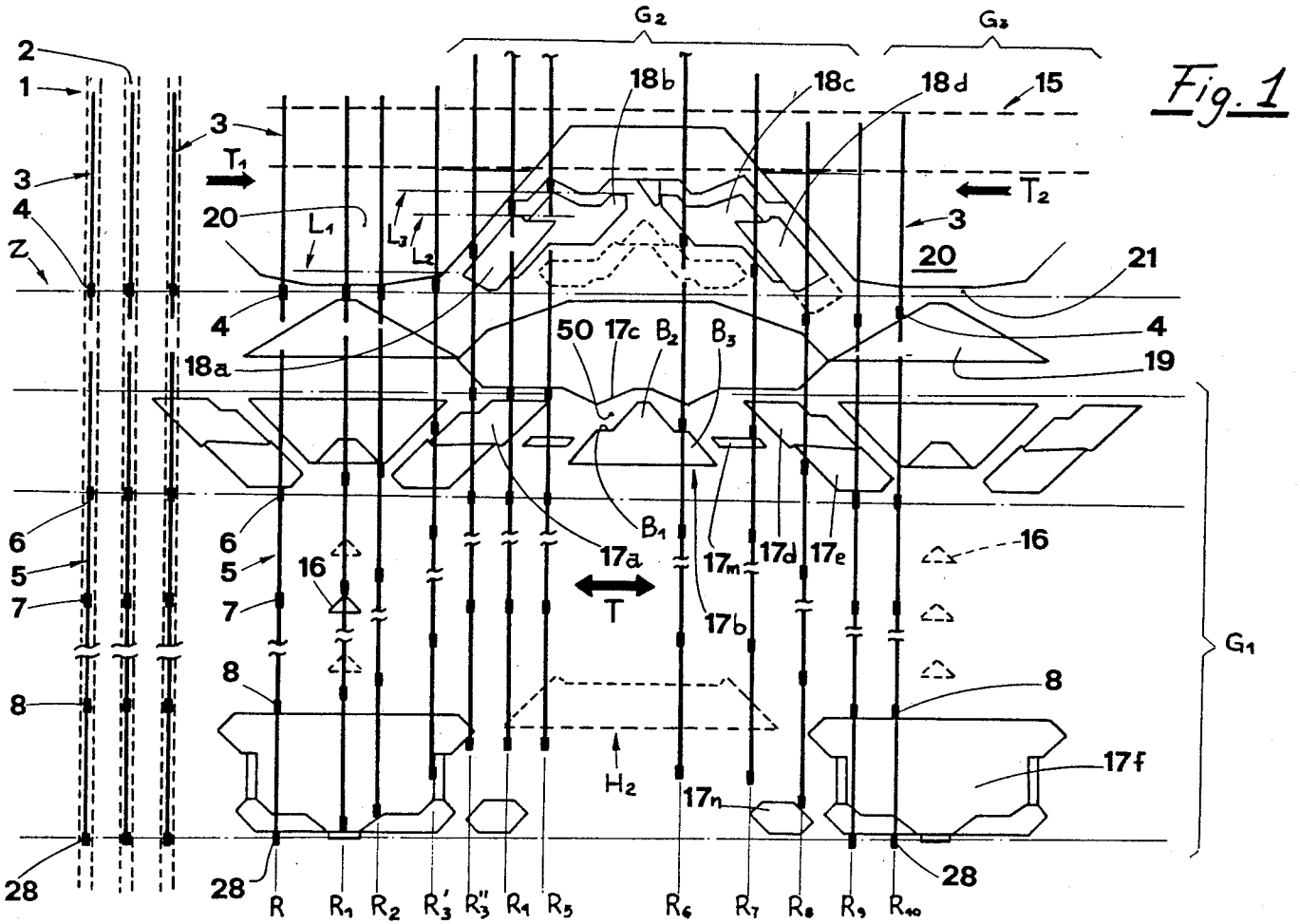
FIG. 1 is a diagrammatic illustration of the operational cams on the carriage, and of a selected sinker-needle assembly, showing a large number of important subsequent positions.

With reference to the said figures, 1 indicates a needle bed featuring equidistantly spaced slots 2, that are perpendicular to the direction T of travel of a carriage (not illustrated), equipped with operational cam assemblies which will be spoken of in greater detail below.

In each slot, proceeding from top to bottom, there are a needle 3, featuring a butt 4, and a slection sinker 5, (of the type for example claimed in EPC No. 85830068.4) which has at least four butts, 6, 7, 8 and 28, first, second, third and fourth butt, respectively.

The butt 4 of the needle 3 features a spring extension 9 that is an integral part of the needle body; the said extension bending towards the inside of the slot 2 when not subject to any outside force, and bearing up against a plate 10 which forms a part of the needle body, projecting downwards beyond extension 4.

The extension 9 features a groove 14 which can be entered from above, and which is always located completely within its related slot 2, independently of the position (described in greater detail below) to which the extension has been set.

The movement of the needle 3 is guided by the bottom of the slot on one side, and by a guide plate 15 on the other, which is joined to the needle bed 1 and situated on the inside of the slots formed in the latter; the said guide plate 15 being able to fit into the groove 14 of each needle selected, for reasons that will be explained below.

The upper head 11 of every selection sinker 5 features a recessed area in the surface facing the bottom of the slot 2 that creates a seat 12, no wider than the thickness of the plate 10 and a ledge 13.

The upper end of the surface of the head 11 facing the outside of the slot 2, is slanted, forming a pointed or cusp-shaped end 11*a*.

The cams may be considered as divided into selection cams 16, and three operational cam assemblies G1, G2 and G3 (see EPC No. 86890240.7 made by the same applicant).

The selection cams 16 are aligned in assemblies in a direction that is perpendicular to direction T; when in its operational position, (shown by the bold lines in FIG. 1), each cam 16 strikes against the second butt 7 of the corresponding sinker 5, lifting the latter from its idle position R to a first intermediate position R1.

The first operational cam assembly G1 is designed to strike against the fourth and first butts 28 and 6 of the sinker 5 in that order, and only when the latter is in the first position R1; this causes the sinker 5 to move through a large number of positions, shown in the figures as R2, R'3, R''3, R4, R5, R6, R7, R8, R9, R10; in positions R''3, R4 and R5, the sinker 5 is in its fully raised position, whilst in positions R9 and R10 it is once again in the idle position R.

The cams in the second operational cam assembly G2 can be either fixed and/or movable, (sce EPC No. 86890240.7), are located above the first cam assembly, and operate in a first longitudinal band F1, which extends above and below the longitudinal line Z delineated by the butts 4 of the needles 3 in their idle position; the said band is located at a predetermined distance t1 from the longitudinal face 1*a* of the needle bed 1 below it.

The cams in the third operational cam assembly G3 are fixed and situated downstream of the above-mentioned second-assembly (in relation to the direction T2 of travel of the carriage), and operate in a second longitudinal band F2, which is located immediately below line Z; this band is located at a predetermined distance t2, shorter than the first distance t1, away from the aforementioned longitudinal face 1*a*.

Fixed cams 20 are located above the operational cams of the third cam assembly G3, and above line Z, operating in a third band F3 that is located at the aforesaid distance t2 away from the face 1*a*; a longitudinal channel 21, centred in relation to line Z, is formed between the cams of the third assembly G3 and the fixed cams 20.

Those aspects of the operation of the automatic knitting machine directly affected or influenced by the improvements described herein will now be described.

The carriage moves and operates in both directions T1 and T2; since we are dealing with the movement of the carriage and needle bed in relation to one another, it shall, for the sake of clarity, be supposed that it is the latter which moves in directions T1 and T2, and the carriage that is motionless.

Figure 2:
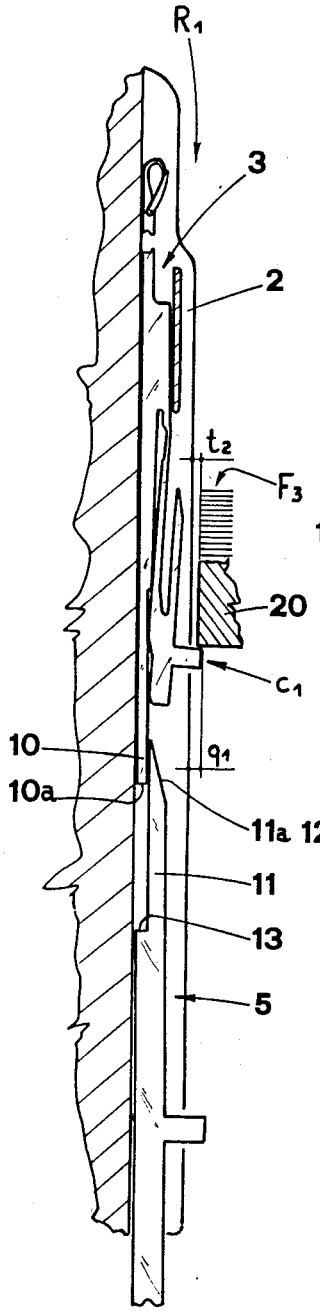
FIGS. 2 to 11 are large scale diagrammatic illustrations of cross sections in planes perpendicular to the direction of travel of the carriage, these planes corresponding to the sinker-needle assembly positions illustrated in FIG. 1.

FIG. 2 shows the idle positions of both the sinker 5 and needle 3; in this position, the inside surface of the upper head 11 of the sinker comes into contact with the adjacent surface of the plate 10. In the idle position, the extension 9 is in the inside position C1; in this position the butt 4 of the needle 3 protrudes from the face 1a by an amount q1, that is longer than the second distance t2, but shorter than the first distance t1; in this way the operational cams in the second cam assembly G2 do not strike against butt 4, and neither do the cams in the third cam assembly G3, since the butt 4 moves through channel 21.

As a logical consequence of this, the non-selected needles are in no way subjected to any mechanical forces, this bringing all the advantages well known to experts in the sector.

Figure 3:
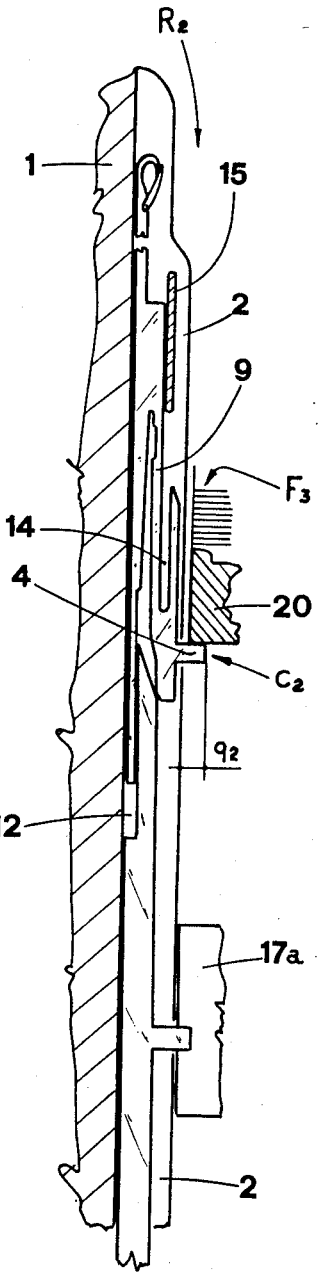

The selection of the sinker 5 causes it to be lifted up, as stated; when the sinker moves beyond a predetermined intermediate position (shown as R2 in FIG. 1), the cusp-shaped part 11*a* of the head 11 striking against the extension 9, which is, as a consequence, made to bend outwards (FIG. 3); this striking movement takes place (position R2, FIG. 3) as soon as the butt 4 is located in the operating zone of the fixed cam 20, located upstream, which, operating in the above-mentioned third band F3, functions as a stop for the butt itself; in this way the butt 4 of the needle 3 is guided along, in that it is forced to follow the outline of cam 20 whilst the extension 9 is bent outwards. As a result of this striking movement, the head 11 is inserted between the plate 10 and extension 9; it is fully inserted when the ledge 13 of the sinker 11 and stop 10*a*, formed by the lower face of the plate 10, come into contact with one another: this situation occurs before the butt 4 leaves the operating zone of the above-mentioned cam 20 (position R'3, FIG. 1).

In position R'3, the extension 9 is made to bend out to a maximum by the head 11, such that the butt 4 of the needle 3 is situated in its outermost position C2 in relation to the slot; in this position, the aforementioned butt projects from the face 1*a* by an amount q2 that is greater than the first distance t1.

When the sinker 5 is raised beyond position R'3, the needle 3 is lifted (ledge 13 in contact with stop 10*a*) from its idle position to a first level L1.

Figure 4:
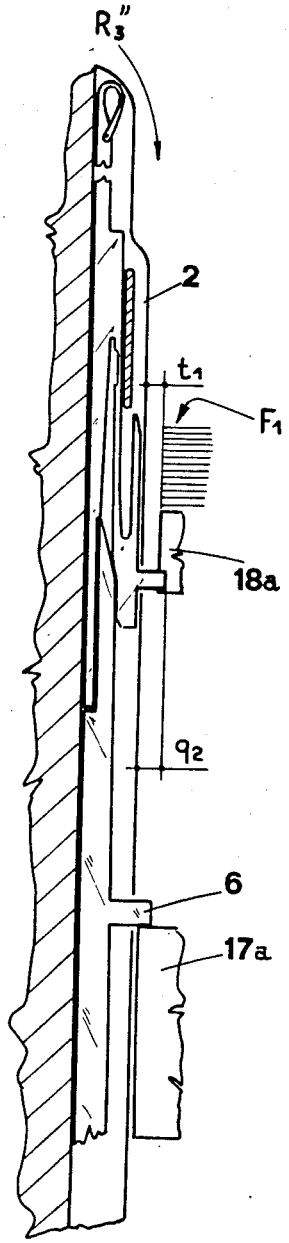

In position R''3, the butt 4, located above level L1, has already been struck by a cam 18*a* in the second cam assembly G2 (FIG. 4): this is made possible by the fact that the butt 4 is situated in the aforementioned first band F1; FIG. 4 also shows the fully raised position of the sinker 5: in this position, the first sinker 6 has already been lifted by a fixed cam 17*a* in the first cam assembly G1.

Figure 5:
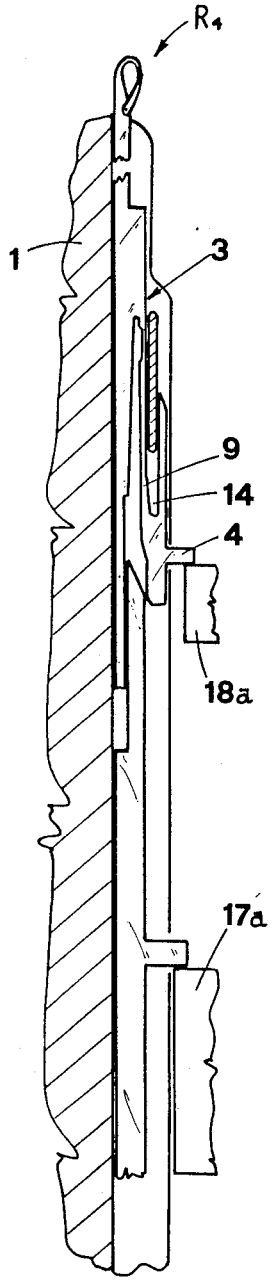

The action of cam 18*a* on the butt 4 causes the needle 3 to be lifted, this having the consequence of gradually disengaging the head 11 from the needle 3 itself; the head keeping the extension in its outermost position C2, however, until level L2 has been reached (see FIG. 5).

Before the head 11 has completely disengaged from the needle 3, guide plate 15 is (albeit partially) fitted into groove 14 (e.g.: position R4, FIG. 5).

Cam 18*a* lifts the needle up to the aforementioned level L2, enabling the stitch to be formed (see EPC No. 86890240.7).

Figure 6:
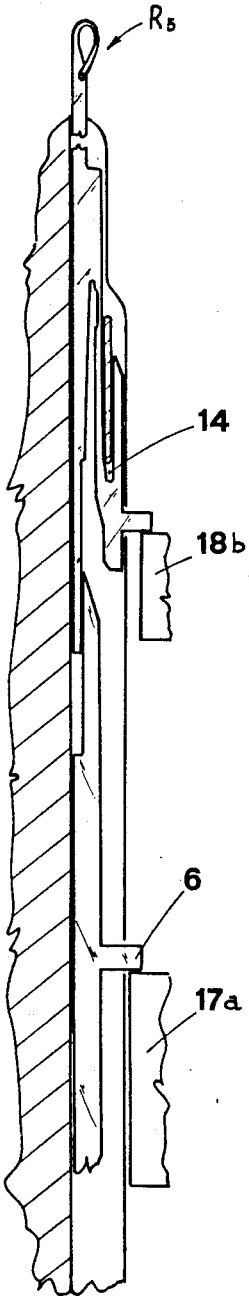

Should it be necessary for the needle to be lifted further, (by means of an operational cam 18*b* in the second cam assembly G2 up to a level L3 in which the butt of the needle is fully lifted), the butt 4 is made to stay in its outermost position C2 as a result of the guide plate 15 fitting into groove 14 (FIG. 6).

Figure 7:
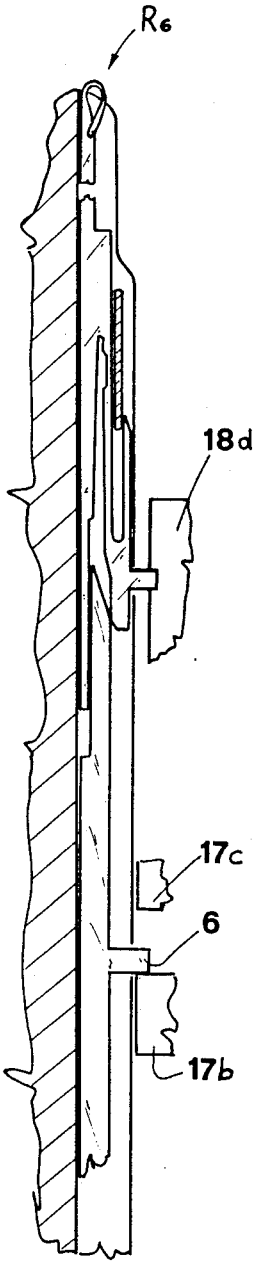

A further operational cam 18*c* in the second cam assembly G2 ensures that the butt 4 is gradually lowered until position R6 (FIG. 7), when, (before the guide plate 15 has disengaged from the groove 14), the head 11 is once more inserted between the plate 10 and extension 9. This happens as a result of the fact that the needle moves down towards the sinker 5 below it; to prevent the latter from moving down when not desired, an operational cam 17*b* in the first cam assembly G1 features a horizontal portion B1, which initially functions as a stop for the first butt 6 (FIGS. 7 and 12); this cam has an inverted "V"-shaped raised central portion B2, located above the horizontal sections B1, which, together with a cam 17*c* above it (in the first cam assembly G1), delineates a channel 50 (see FIG. 1) that follows an inverted "V" course, the apex of which is located at a height not exceeding the maximum height reached by the first butt 6.

The aforementioned first butt 6 moves dynamically upon a further cam 17*m*, that is horizontal and forms part of the first cam assembly G1; this cam 17*m* functions as a stop for the first butt 6, enabling it to be fully inserted as described above (FIG. 8, position R7 in FIG. 1). A movable operational cam 18*d* in the second cam assembly G2 operates downstream of the operational cam 18*c*, also in the second cam assembly, having the purpose of adjusting the knitting density (once more see EPC No. 86890240.7).

Figures 8, 9, 10, 11:
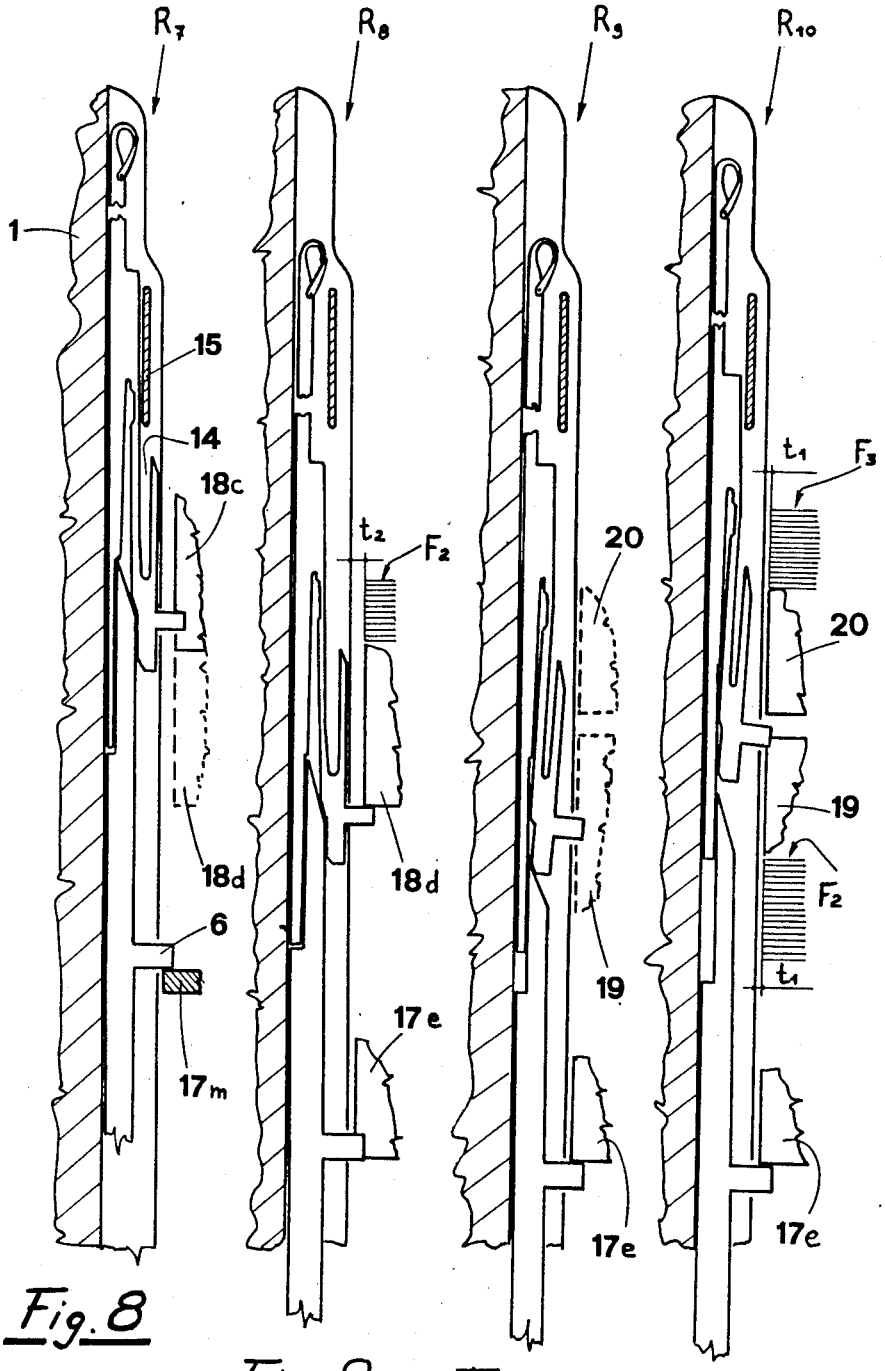

The movable cam 18*d* lowers the butt 4 of the needle 3 below line Z (FIG. 1); the lowering of the needle below position R7 takes place in synchrony with the lowering of sinker 5, in that the operating surfaces of cams 18*c*, 18*d*, and 17*d*, 17*e* in the second cam assembly have exactly the same slope: this is illustrated in FIG. 9, showing position R8 in FIG. 1.

To prevent the sinker 5 from moving down when not desired during this stage, there is a fixed cam 17*n* (FIG. 1) which acts as a dynamic stop and guide for the fourth butt 28.

The movable cam 18*d*, (shown by a broken line in FIG. 1, and by a bold line in FIG. 9), moves the butt 4 of the needle 3 to position R8; the butt cannot be lowered below this position, whilst the sinker 5 is progressively lowered, at first still by cam 17*e* (acting on the first butt 6) and then by cam 17*f* (acting on the fourth butt 28).

This gradually causes the head 11 to become disengaged from the needle 3 (position R9 in FIG. 1 and FIG. 10) the butt 4 thus gradually moving from the outermost position C2 (first band F1) to position C1 (second and third band F2, F3).

The presence of the operational cam 19 in the third cam assembly G3, enables the butt 4 to move back to line Z; cam 19 operating, as stated above, in the second band F2, such that it strikes against the aforesaid butt 4 in order to return it to channel 21, where it moves in alignment with line Z.

The butt 4 of a needle 3 which has not been selected is therefore under no circumstances struck by the operational cams in the carriage. The butt of a needle which has been selected, on the other hand, is struck by the operational cams in the second and third cam assemblies in that order; the needle in this way being able to complete all the operations described in the introduction.

It should be emphasised that the insertion of the head 11 between the extension 9 and plate 10, caused by the head 11 moving towards the needle 3 or, vice versa, by the movement of the latter towards the said head, does not cause any unwanted movement of the needle and sinker respectively.

The improvements proposed above also enable non-selected needles to be sent into operation when required.

There are two cams 18*g* and 18*h* for this purpose in the second operational cam assembly G2, which may be moved, independently of one another, from an operational position K1 (shown by bold lines) to an inoperative position K2 (shown by feint lines); these two cams are located above the said line Z, and are oriented in the shape of an inverted "V" that is symmetrical to the vertical plane W, equididstant from two consecutive selection cam assemblies 16, and identical to the above-mentioned inverted "V"-shaped channel 50.

It should be emphasised that the aforesaid cams 18*g* and 18*h* are situated in the above-mentioned second band F2 when in their operational position K1; finally, the distance between these two cams, 18*g* and 18*h*, and the ascending and descending portions, respectively, of the upper central part B2 of the lower cam 17*b* of the aforementioned first cam assembly G1, is equal to the distance between the first butt 6 and the butt 4 of the needle 3 when the end 11 of the sinker 5 is fully inserted between the extension 9 and the plate 10, (ledge 13 in contact with stop 10*a*).

Below the aforesaid lower cam 17*b*, there is an operational cam 17*g*, which features two side ramps that slant across line S, where the third butts 8 of the sinkers 5 are located when the latter are in their idle position R.

The above-mentioned cam 17*g* may be moved from an operational position H1, (shown by bold lines in FIG. 12), to an inoperative position H2, (shown by feint lines in FIG. 1); in the operative position H1, the cam 17*g* strikes against the third butt 8, providing that the related sinker 5 is in its idle position R.

The ascending portion of cam 17*g* (in position H1) lifts the sinker 5 (e.g. position A1 in FIG. 12) up to position A2 (FIG. 12): when it is in this position, the end 11 of the sinker 5 will have already struck against the extension 9.

The sinker 5 is prevented from lifting when cam 17*g* first makes contact with the third butt 8, due to the guiding action of cam 17*n*, upstream, on the fourth butt 28.

Figure 12:
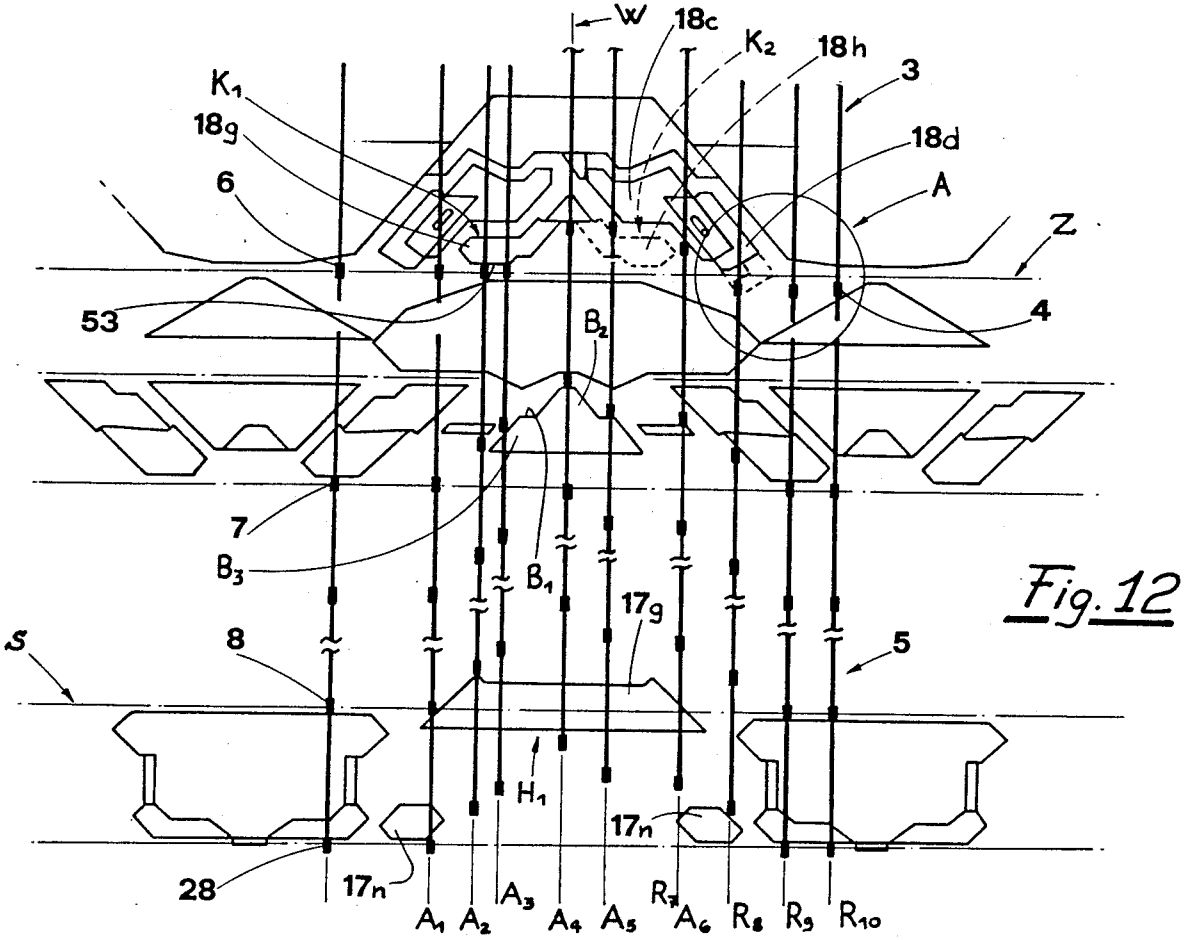
FIG. 12 is a diagrammatic illustration of the operational cams on the carriage which strike the non-selected sinkers, as well as a non-selected sinker-needle assembly in a large number of important subsequent positions.

The sinker 5 is lifted up further, higher than position A2, as a result of the ascending ramp of the lower central part B3 of the above-mentioned lower cam 17*b* striking against the first butt 6; this lifting motion causes the aforesaid end 11 to be fully inserted between the extension 9 and plate 10, (position A3 in FIG. 12, showing similar conditions to those illustrated in FIG. 4).

The needle 3 is prevented from moving upwards in positions A1, A2 and A3 due to the fact that the butt 4 is stopped up against a horizontal portion 53, (located in band F2), forming part of the first part of cam 18g, (this being the one concerned here, if one supposes that the carriage is motionless and that it is the sinker-needle assembly which moves in direction T1), and extending towards the outside of the inverted "V" formed by cams 18*g* and 18*h*.

The sinker-needle assembly is, for this reason, lifted in synchrony from position A3 to position A4 (fully raised).

If cam 18*h* is in the operational position K1, the aforementioned assembly is lowered in synchrony until reaching position A5 (similar to position R6 in FIG. 8).

If, on the other hand, cam 18*h* is in the inoperative position K2 (as in FIG. 12), the sinker 5 is lowered, but extension 9 is kept in position C2; cam 18*c* in the second cam assembly G2, striking against the butt 4 of the needle, and returning the conditions in position A6 to those already described for position R7 in FIG. 8.

The same favourable considerations expressed above hold true regarding this embodiment aswell, in addition to the possibility of position A6.

The improvements proposed, prevent the non-selected needles and yarn of the fabric hooked to the latches of these needles from being subjected to outside forces, limit the frequency of the "hammering" of the needle butts against their corresponding knitting density adjustment cams 18*d*, and the means working in conjunction with them, whilst at the same time having the advantage that they do not interfere with the correct operation of the selected needles.

This leads to a reduction in needle breakages, maintenance, vibration and noise in those automatic knitting machines incorporating the improvements described above, and running at the same speed as known machines.

The solutions proposed enable the aforesaid running speed to be increased, thereby improving the productivity of the machines concerned.

With the help of a different constructional embodiment of the machine, illustrated in FIGS. 13 and 14, the improvements proposed enable one to form a special type of knitting stitch, which requires the butts 4 of the non-selected needles to be lowered below the above-mentioned line Z, so that the difference in level between them and the butts of the selected needles is equal to a predetermined value "p".

The above embodiment invloves the use of an additional cam 60, which is mounted (using means 61) on every knitting density adjustment cam, such as cam 18*d*, for example; the operating surface 60*a* of this additional cam is located immediately up against but higher up than the related operating surface of cam 18*d*: the difference in the value "p" between the bottom edges of the said cams can be adjusted by operating on the said means 61 following a known procedure.

Figure 14:
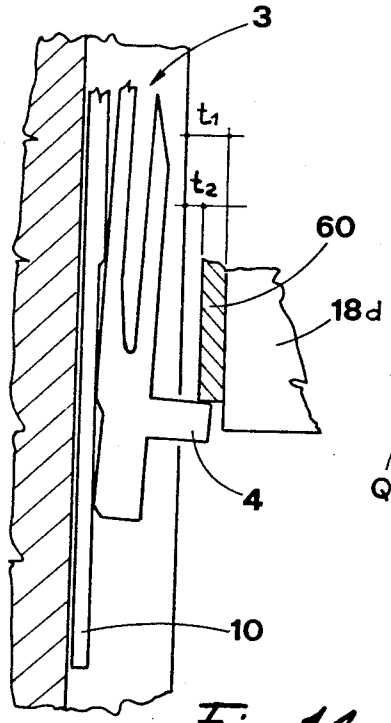
FIG. 14 is an illustration of cross-section I—I in FIG. 13.

The additional cam 60 operates in the above-mentioned second band F2, and is thus able to strike against butt 4 even when the latter is in its inside position C1 (see FIG. 14).

Figure 13:
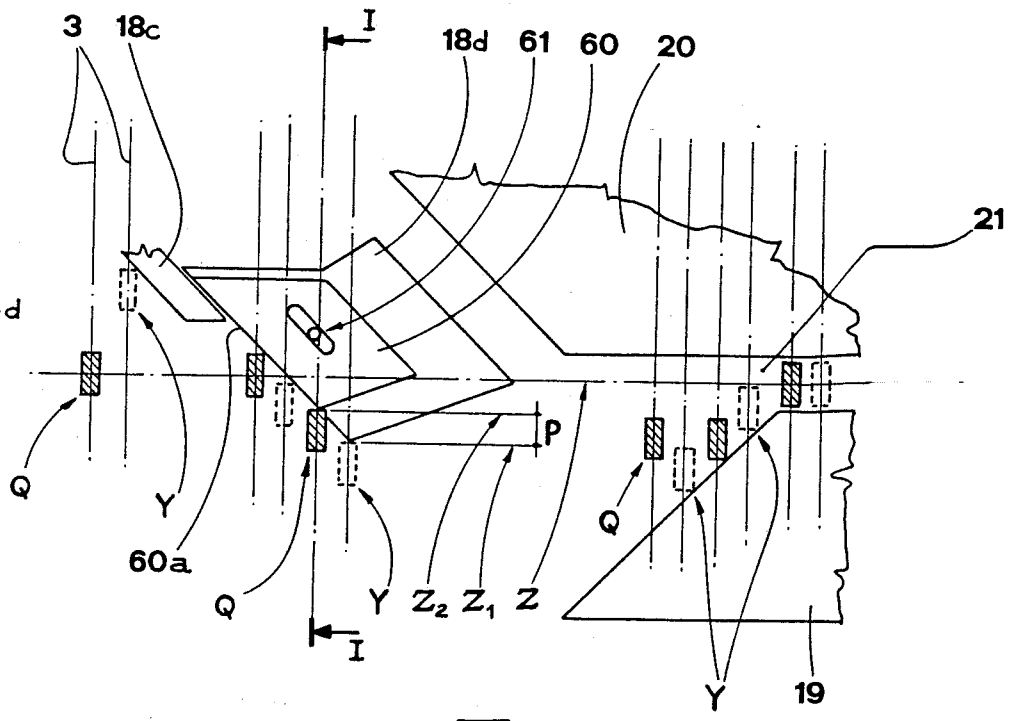
FIG. 13 is an illustration on a larger scale than those above, showing a different constructional embodiment of detail A in FIG. 12, as well as a large number of positions assumed by two butts of a related selected and non-selected needle respectively.

The positions Y through which the butt 4 of a selected needle is moved (by means of cam 18*d*) on its way down to a further lowered position Z1 are illustrated by the broken lines in FIG. 13; the positions Q through which the butt 4 of a non-selected needle is moved (by means of the additional cam 60) on its way down to a further lowered position Z2, located above Z1, are also illustrated in this figure; cam 19, which follows on behind, makes the butts located in positions Z1 and Z2 return so that they run along the aforementioned line Z.

What is claimed is:

1. A perfected automatic flat knitting machine including two flat needle beds inclined away from each other in a downwards direction, and located so that they are symmetrical to one another in a longitudinal vertical plane, each of said needle beds having equidistantly spaced slots in each of which a needle featuring a butt is located from the top proceeding downwards, and a sinker featuring at least four butts, first, second, third and fourth butt, respectively, all protruding from the related needle bed; said machine also being fitted with a carriage that runs above said needle beds, including: movable selection cams, each of which, when in its operational position, strikes against said second butt of the corresponding sinker selected, consequently raising the latter from its idle position to a first intermediate position; a first assembly of movable and/or fixed operational cams designed to strike against the above-mentioned first and fourth butts of said selected sinker, lifting the latter from its said first intermediate position to a fully raised position and subsequently lowering it to said idle position, the lifting of said sinker beyond a predetermined second intermediate position, higher than said first intermediate position, causing said sinker to strike against said needle, as a result raising said needle from its idle position to a first level; a second assembly of operational fixed and/or movable cams which operate in a first longitudinal band extending above and below a longitudinal line formed by said butts of said needles in their idle position, said cams being equidistant from a face of said needle bed below them, located at a predetermined first distance away from it; a third operational fixed cam assembly, located downstream of the aforementioned second assembly in relation to the direction of travel of said carriage, operating in a second longitudinal band extending below said longitudinal line, said cams in which are equidistant from said needle bed below them, located at a second predetermined distance away from it, the length of which is lower than said first distance; said butt of said needle being mounted on said needle body by means of a spring extension which, in said idle position, keeps said butt partially within its related slot, from which it protrudes into the above-mentioned second band alone, and when the upper head of said sinker strikes against said spring extension, as a result of the sinker itself being beyond the aforesaid second intermediate position, said spring extension is bent towards the outside of its related slot, thus enabling said butt of said needle to enter the above-mentioned first band, said sinker and needle featuring a ledge and stop respectively, that are brought into contact with one another, causing both said sinker and needle to be driven in the same direction, when said butt of said needle has been positioned in the aforementioned first band, with said carriage provided with means for striking said butt of said needle, designed to guide the lifting of the latter as a result of said head of said sinker striking against the above-mentioned extension.

2. A machine as in claim 1, wherein said second operational cam assembly is designed to lift every selected needle by its corresponding sinker to a level at which mutual disengagement of said extension of said needle and said upper head of said sinker is effected, and wherein the aforementioned extension features a groove which extends downwards above said butt of said needle, and is constantly located completely within said slot housing the related needle, independently of the position of the aforementioned extension, and wherein there is a guide plate which is mounted on said needle bed, traversing all said slots in the latter, and located in an inside position in relation to the longitudinal outside face of said needle bed itself, said guide plate being designed to fit into said groove before said upper head of said sinker and aforesaid extension have disengaged from one another, thus keeping said butt of said needle positioned in the aforementioned first band.

3. A machine as in claim 1, wherein the aforementioned extension is inclined in relation to the axis of its related slot, towards the inside of the latter when it is in its idle position.

4. A machine as in claim 3, wherein said body of said needle extends downwards beyond its related extension in a position to the inside of the latter, in the form of a plate, an inside face of which slides along the bottom of the related slot, and the outside face of which acts as a rest for said extension when in its idle position, and as a guide for said head of said sinker when said head is being inserted between said plate and extension.

5. A machine as in claim 1, wherein said first operational cam assembly features two cams, one lower and one upper, which are symmetrical in relation to a vertical plane equidistant from two consecutive movable selection cam assemblies, said lower cam comprising an upper central part, two horizontal portions, and a lower central part, said upper central part and said upper cam together delineating an inverted "V"-shaped channel, the apex of which is located at a height not exceeding the maximum height reached by said first butt of each sinker, and in which said second assembly includes two cams, which can be moved from an operational position to an inoperative position, symmetrical in relation to this latter vertical plane, located above said line delineated by said butts of said needles in their idle position, and oriented in an inverted "V" that is identical to said "V" shape of said channel, and wherein the above-mentioned first operational cam assembly includes an operational cam that is able to move from an operational position, in which it strikes against said third butt of each sinker when the latter is in its idle position, and an inoperative position, and features two side ramps designed, as a consequence of said striking action, to lift said sinker so that said upper head of the latter strikes against said extension, causing said first butt of said sinker to be positioned on a lower central part of the aforementioned lower cam, this lower central part being able to strike against the aforesaid first butt, lifting said sinker up further, consequently causing said head to be inserted between said extension and plate, until said ledge and stop come into contact, and wherein the above-mentioned two operational cams in said second assembly, delineating the aforementioned inverted "V", are located at a distance from the upper central part of the aforesaid lower cam which has a value, measured in the just said vertical plane, which is equal to a distance between said butt of said needle and said first butt of said sinker when the above-mentioned ledge and stop of said sinker and needle respectively, have come into conatct with one another, and, finally, wherein first parts of the previously mentioned two operational cams in said second assembly feature horizontal portions which extend towards the outside of said inverted "V" delineated by said cams, operating in the above-mentioned second band, and acting as a stop for said butt of said needle, when said upper head of said sinker is being inserted between said extension and plate, as a result of said sinker itself having been lifted up by, in the following order, the aforesaid operational cam and lower central part of the above mentioned lower cam.

6. A machine as in claim 1, wherein said second operational cam assembly includes a cam, which is located downstream of said assembly in relation to said direction of travel of said carriage, for adjusting the knitting density, this cam being designed to strike against said butt of said needle selected, in order to lower said butt below said line delineated by said butts of those needles in said idle position, each knitting density adjustment cam featuring an additional cam, which is removably mounted on said knitting density adjustment cam, operating in the aforesaid second band, having an operating surface that is located immediately up against an operating surface of said related knitting density adjustment cam, with the lower edge of said operating surface of said additional cam being situated at a distance, the value of which can be adjusted, above the bottom edge of said cam to which said additional cam is removably mounted.

7. A machine as in claim 4, wherein said inside surface of said upper head of said sinker features a discontinuous portion which forms a seat, which is designed to at least partially receive the above-mentioned plate, independently of the mutual positions between said sinker said needle, as well as the previously mentioned ledge, designed to come into contact with said stop constituted by the bottom face of said plate.

8. A machine as in claim 1, wherein said end of said upper head of said sinker has a cusp shape formed by an inclined surface which moves in from the surface of said head facing the outside of said slot.

* * * * *